US005902176A

United States Patent [19]

Chen

[11] Patent Number: 5,902,176

[45] Date of Patent: May 11, 1999

[54] CLAMPING DEVICE FOR A SANDING TOOL

[76] Inventor: Kun-You Chen, No. 69, Alley 39, Lane 99, Sec. 3, Rd., Kang-Ning, Taiwan

[21] Appl. No.: 08/946,201

[22] Filed: Oct. 7, 1997

[51] Int. Cl.[6] ..... B24D 15/00

[52] U.S. Cl. ..... 451/524; 451/520; 451/519; 451/517

[58] Field of Search ..... 451/524, 523, 451/520, 519, 517, 514, 502, 499, 356, 354, 344

[56] References Cited

U.S. PATENT DOCUMENTS

| | | | |
|---|---|---|---|
| 1,544,368 | 6/1925 | Brennan | 451/524 |
| 2,464,296 | 3/1949 | Ekstrom | 451/517 |
| 2,541,330 | 2/1951 | Bourdunis | 451/524 |
| 3,571,986 | 3/1971 | Champayne | 451/524 |
| 4,075,793 | 2/1978 | Vogel et al. | 451/356 |
| 5,283,988 | 2/1994 | Brown | 451/354 |

*Primary Examiner*—Robert A. Rose
*Attorney, Agent, or Firm*—Bacon & Thomas PLLC

[57] ABSTRACT

A clamping device a sanding tool is comprised of a fixing body, a spring, a clamping plate, a pressing block and a buffer body; wherein, the fixing body is a rectangular base on the proper position of the center of which is installed with a high projected handle, while grooves are installed on the two sides of the base near the edge portion, a fixing stud is installed between the handle and the grooves, a buffer body is adhered on the bottom of the base, a spring and a clamping plate are attached on the stud; the distal end of the fixing stud is installed with a pin for engaging with said pressing block; by the upwards or downwards pressing force of the pressing block, the sand paper may be fixed.

3 Claims, 5 Drawing Sheets

CLAMPING DEVICE FOR A SANDING TOOL

BACKGROUND OF THE INVENTION

1. Field of the invention

The present invention relates to a clamping device for a sanding tool especially to a clamping device for a sanding tool which is fitted to be used in the wood products and in decoration.

2. Description of the Prior Art

In finishing the wood product for deriving a beautiful and smooth appearance, in generally, the surface must be smoothed, and then by other preceding process, such as painting, adhering texture paper, etc.

But in conventional smoothing process, it is generally punishing to apply the sandpaper by hand. In this method, the hand is directly located on the sand paper. If the area to be sanded is small, it is a convenient way. But if the area is large, such as in decoration, the door plate, wine cabinet and book case, etc., and the hand is located directly on the sand paper, the heat energy will be induced be induced by friction and will be painful, thus the time required may be increased.

Therefore, in the present invention, it is intended to invent a brand new clamping device for emery cloth table wherein the drawbacks in the prior art is improved, the components thereof has a simple structure; by the upward ejecting and downward pressing of a pressing block, a clamping plate will be tightened or released so that the sand paper is fixed.

SUMMARY OF THE INVENTION

Accordingly, the main object of the present invention is to provide a clamping device for a sanding tool the structure of which is easy and the clamping device for a sanding tool has clamping has fixing functions.

A clamping device for a sanding tool comprises a fixing body, a spring, a clamping plate, a pressing block and a buffer body, wherein, the fixing body is a rectangular base on the proper position of the center of which is installed with a high projected handle, while grooves are installed on the two sides of the base near the edge portion, a fixing stud is installed between the handle and the grooves, a buffer body is adhered on the bottom of the base; a spring and a clamping plate are attached on the stud; the distal end of the fixing stud is installed with a pin for engaging with said pressing block; by the upwards ejecting or downwards pressing force of the pressing block, the sand paper may be fixed.

The present invention will be better understood and its numerous objects and advantages will become apparent to those skilled in the art by referencing to the following drawings in which:

DETAILED DESCRIPTION OF THE PREFERRED EMBODIMENT

Figure 1:
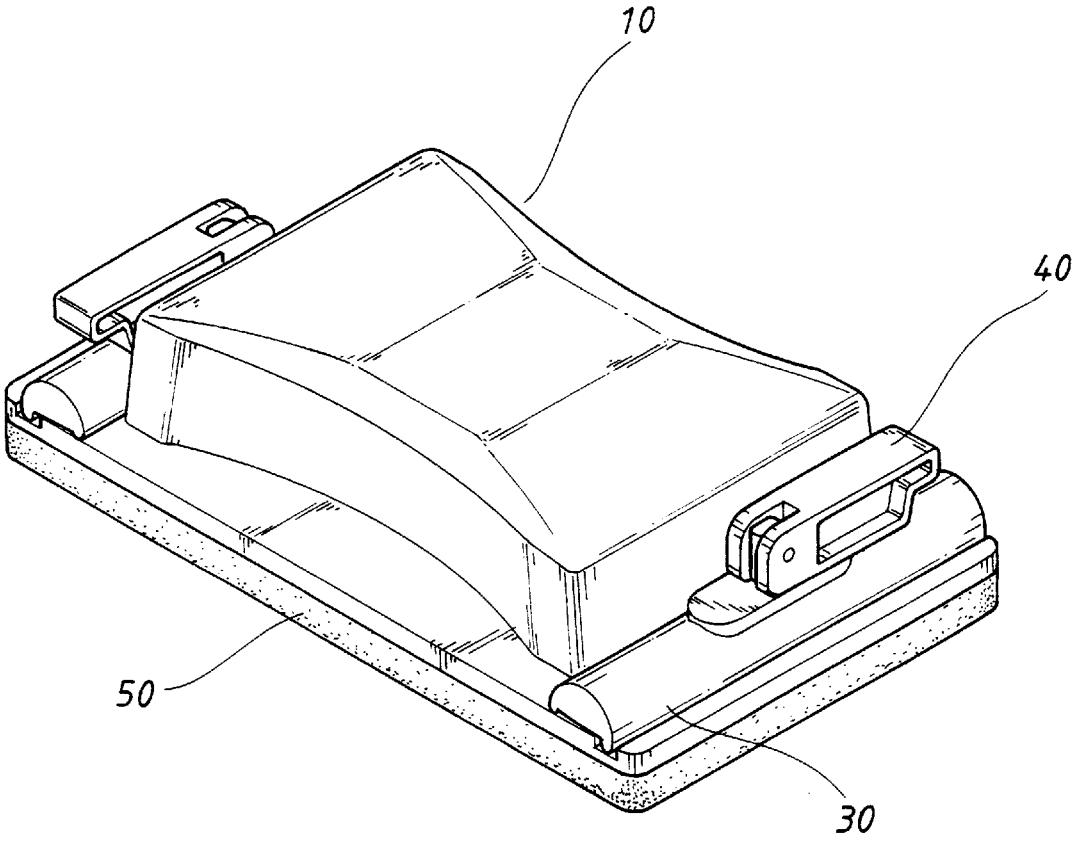
FIG. 1 is a perspective view shows the appearance of the embodiment in the present invention.

The clamping device for a sanding tool of the present invention as shown in FIG. 1 is comprised of a fixing body 10, a spring 20, a clamping plate 30, a pressing block 40 and a buffer body 50.

Figure 2:
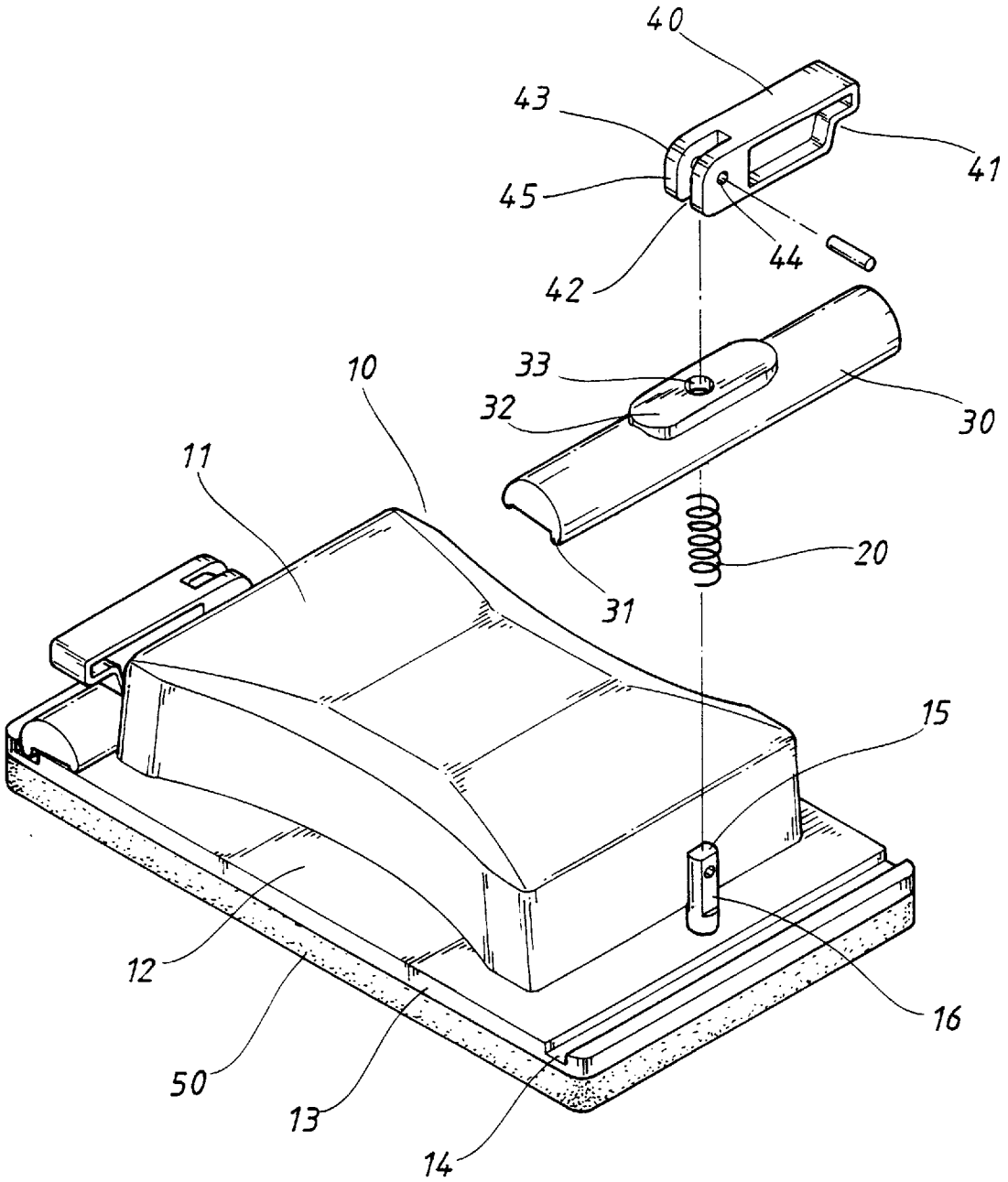
FIG. 2 is the exploded view of the components in the present invention.

As shown in FIG. 2, the fixing body 10 is a rectangular base 13 on the proper position of the center of which is installed with an upstanding handle 11, and a hand positioning slot 12 is installed on the two sides of the handle 11, while grooves 14 are installed on the two sides of the base 13 near the edge portion. A raised locating stud 15 is installed between the handle 11 and the two sides grooves. A flat buckling surface 16 is arranged on the two sides of the locating stud 15 and a pin is installed on the top end of the buckling surface 16.

The clamping plate 30 has a hemispherical shape and the two sides thereof are installed with a flange 31, and the outside flange is more convex than that of the inside flange. A long ellipse buckling surface 32 is installed at the center of the clamping plate 30, and a stud hole 33 penetrates through the buckling surface 32.

The pressing block has an approximate rectangular and a longitudinal clamping mouth 42 is installed on one end of side block and a pin hole 44 installed on the clamping piece 45 on the two sides of the clamping mouth, while an arc piece 43 is installed on the upper edge of said clamping piece 45. An inwards concave piece 41 are installed on the lower edge of said block. The two sides of said block is arranged as a frame body with groove.

Now referring to FIGS. 1 and 2, a buffer body 50 is adhered on the base 13 on the bottom of the locating body 10. After the fixing stud 15 is penetrated by a spring 20, a clamping plate 30 is further penetrated so that the more projected flange on the outside of the clamping plate is located within the groove 14 on the near end of fixing body 10 and by a fixedly engaged pin.

Figure 3:
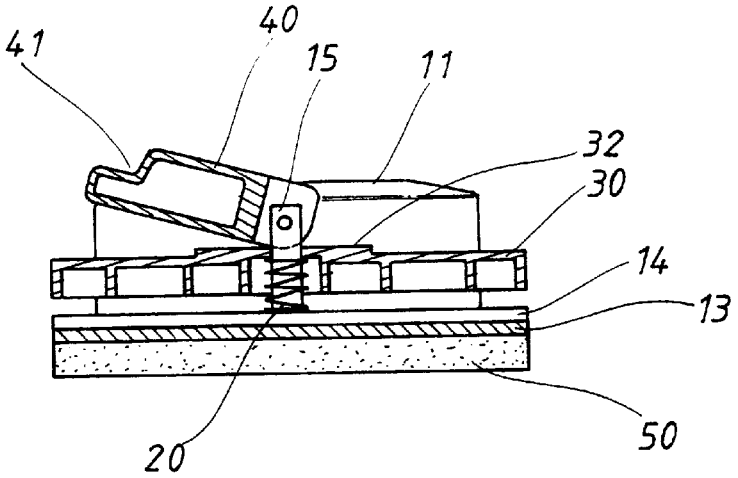
FIG. 3 is the cross section view shown the application of the present invention.
Figure 4:
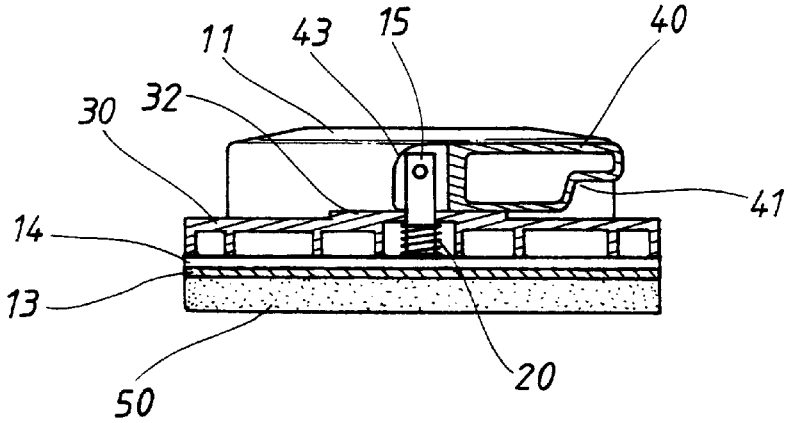
FIG. 4 is a cross section view shown another application of the present invention.

Now referring to FIG. 3, in said assembled fixing device, the arc piece 43 on the front edge the pressing block 40 is rotated relative to the long ellipse buckling surface 32 so that the spring penetrating through the locating stud is released, thus the clamping plate 30 is lifted by the force of the releasing spring and further the flange of the clamping plate 20 is lifted to leave the groove near the fixing body. When the arc piece 43 is rotated in the opposite direction the distal end of the pressing block is pressed downwards so that the long ellipse buckling surface 32 of the clamping plate 30 is along the arc piece 43 on the front end of the pressing block 40 and the clamping plate is pressed downwards by an applied force, further the spring is compressed by outer pressure, thus the flange 31 of the clamping plate 30 is tightly engaged with the groove on the near end of the fixing body.

Figure 5:
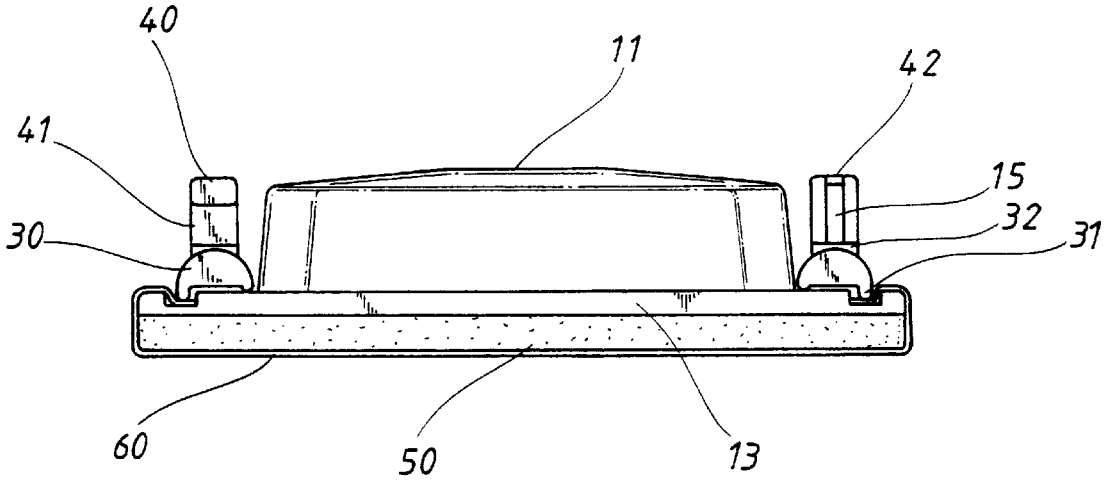
FIG. 5 is a schematic view shown the application in the embodiment of the present invention.

The application of the embodiment in the present invention is shown in FIG. 5. One end of a sand paper is located on the gap between the fixing body 10 and the clamping plate 30 and the pressing block is pressed downwards so that the sand paper 60 is tightly engaged between the flange 30 of the clamping plate 30 and the groove 14 near the end of the fixing body 10. The sand paper is pulled to become flat. The other end thereof is processed as described hereinabove. The sand paper 60 is pulled taut relative to the end of the fixing body 10, thus the object of fixing the sand paper is achieved.

Figure 6:
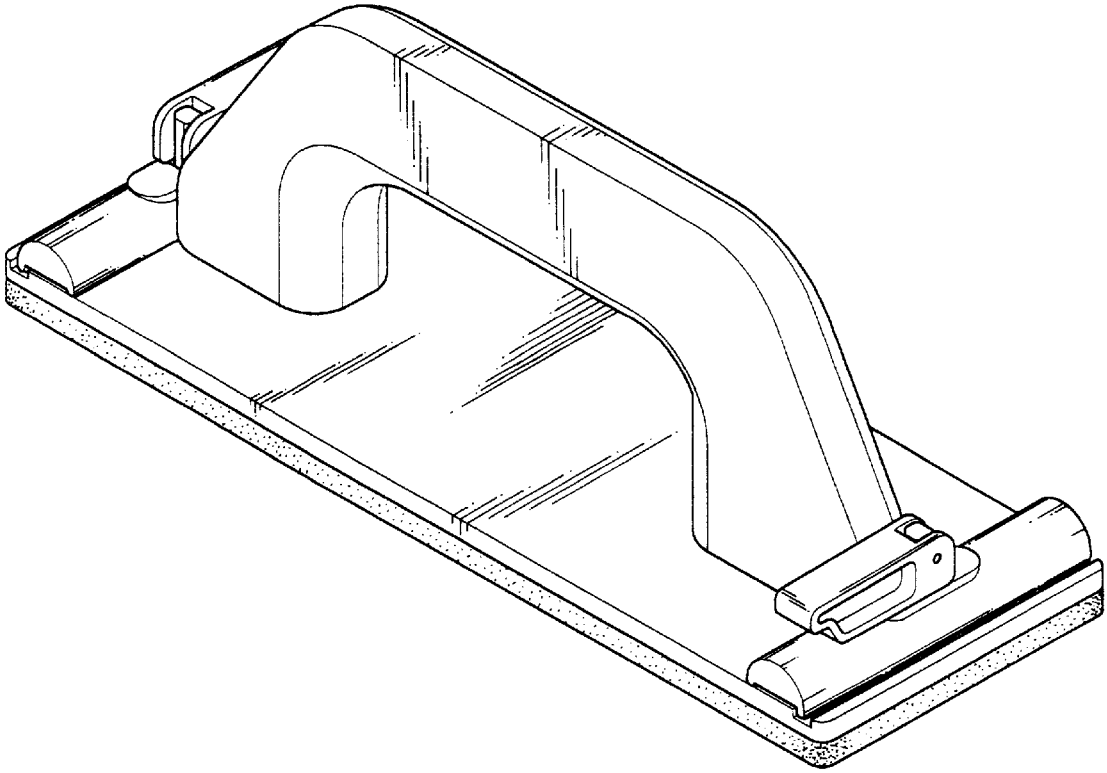
FIG. 6 shows an appearance of another embodiment in the present invention.

FIG. 6 shows the appearance of the sanding tool with the clamping device of the present invention, wherein only the projecting handle 11 of the fixing body 10 is designed to form as a handle 11*a* for being easily grasped, while other components is the same as that in the aforementioned embodiment.

Accordingly, the clamping device for a sanding tool of the present invention has a simple structure and good functions. For the prior fixing device, it is apparently a brand new design. Although certain preferred embodiment of the present invention has been shown and described in detail, it should be understood that various changes and modification may be made therein without departing from the scope of the appended claims.

What is claimed is:

1. A clamping device for a sanding tool, said clamping device comprising:

a rectangular base having two ends, a top surface and a bottom surface, said top surface having an attached centered handle, a groove disposed near each end, and a locating stud integral with said top surface and disposed between said handle and each groove, each said locating stud having a hole at an exposed end for receiving a pin;

a spring and a clamping plate sleeved on each said locating studs, each spring being disposed between said top surface and a respective clamping plate;

two pressing blocks each having a forked end with a pin therethrough and a profile forming a cam surface, each pin being received in a hole of a respective locating stud so that upon pivoting in a selected direction said cam surface operates against a respective clamping plate, wherein each said pressing block is arranged to pivot in one direction to cause a respective clamping plate to clamp an end of a sandpaper into a respective groove and is arranged to pivot in an opposite direction to cause said respective clamping plate to springingly release off of said end of the sandpaper, and wherein each said clamping plate further comprises an outer flange having a projecting length for fitting into a respective groove and an inner flange having a projecting length shorter than said outer flange projecting length.

2. The sanding tool of claim 1, wherein each said spring has sufficient elasticity to lift a respective clamping plate off of said sandpaper when a respective pressing block is pivoted to springingly release said clamping plate.

3. The sanding tool of claim 1, wherein said pressing block is arranged so that a pivoting direction of each of said pivoting blocks to achieve clamping of said sandpaper can be reversed.

* * * * *